US011532907B2

(12) United States Patent
Kim et al.

(10) Patent No.: US 11,532,907 B2
(45) Date of Patent: Dec. 20, 2022

(54) CONNECTOR ASSEMBLY HAVING A TERMINAL POSITION ASSURANCE MECHANISM

(71) Applicants: HYUNDAI MOTOR COMPANY, Seoul (KR); KIA CORPORATION, Seoul (KR); Kyungshin Corporation, Incheon (KR)

(72) Inventors: Ji Hyoung Kim, Gunpo-si (KR); Sang Un Lee, Incheon (KR); Jae Ho Park, Incheon (KR)

(73) Assignees: HYUNDAI MOTOR COMPANY, Seoul (KR); KIA CORPORATION, Seoul (KR); Kyungshin Corporation, Incheon (KR)

( * ) Notice: Subject to any disclaimer, the term of this patent is extended or adjusted under 35 U.S.C. 154(b) by 0 days.

(21) Appl. No.: 17/237,283

(22) Filed: Apr. 22, 2021

(65) Prior Publication Data

US 2022/0123494 A1 Apr. 21, 2022

(30) Foreign Application Priority Data

Oct. 15, 2020 (KR) ..... 10-2020-0133681

(51) Int. Cl.
*H01R 13/436* (2006.01)
*H01R 13/7193* (2011.01)
*H01R 13/66* (2006.01)

(52) U.S. Cl.
CPC ..... *H01R 13/4361* (2013.01); *H01R 13/665* (2013.01); *H01R 13/7193* (2013.01)

(58) Field of Classification Search
CPC ..... H01R 13/719; H01R 13/665; H01R 13/7197; H01R 13/7193; H01R 13/4361; H01R 13/4362
(Continued)

(56) References Cited

U.S. PATENT DOCUMENTS 5,007,888 A * 4/1991 Goutiere ..... H01R 31/08 439/49
5,749,753 A * 5/1998 Chishima ..... H01R 13/113 439/752.5
(Continued)

FOREIGN PATENT DOCUMENTS

JP 3754304 B2 12/2005
KR 101783862 B1 10/2017
KR 10-2018-0044090 A 5/2018

OTHER PUBLICATIONS

Office Action dated Aug. 19, 2022 cited in corresponding U.S. Appl. No. 17/237,411; 9 pp.

*Primary Examiner* — Marcus E Harcum
(74) *Attorney, Agent, or Firm* — Lempia Summerfield Katz LLC

(57) ABSTRACT

A connector assembly includes: a housing having a plurality of accommodating grooves into which a plurality of terminals are insertable, respectively, and having an insertion space recessed in a direction intersecting a direction in which the accommodating grooves extend, the plurality of accommodating grooves being formed in one surface of the housing; a terminal position assurance (TPA) mechanism inserted into the insertion space of the housing in the direction intersecting the direction in which the accommodating grooves extend, and preventing the plurality of terminals inserted into the accommodating grooves from being separated; and a connection device fixed to the housing or the TPA mechanism and forming a circuit electrically connected to the plurality of terminals inserted into the accommodating grooves.

8 Claims, 7 Drawing Sheets

(58) Field of Classification Search
USPC ..... 439/620.07, 620.1, 620.14, 620.22, 752
See application file for complete search history.

(56) References Cited

U.S. PATENT DOCUMENTS

| | | | | |
|---|---|---|---|---|
| 6,645,003 | B2 | 11/2003 | Yoshida et al. | |
| 7,241,168 | B2 * | 7/2007 | Sakurai | H01R 31/085 439/511 |
| 8,690,607 | B2 * | 4/2014 | Tsukamoto | H01R 31/08 439/620.09 |
| 9,761,978 | B2 * | 9/2017 | Kim | H01R 4/64 |
| 10,148,034 | B2 * | 12/2018 | Lyon | H01R 13/42 |
| 10,483,675 | B2 * | 11/2019 | Nishiyama | H01R 31/08 |
| 10,651,604 | B2 * | 5/2020 | Tsukamoto | H01R 13/7197 |
| 2002/0115355 | A1 | 8/2002 | Yoshida et al. | |
| 2012/0295491 | A1 * | 11/2012 | Ito | H01R 13/4361 439/731 |
| 2013/0303023 | A1 * | 11/2013 | Miwa | H01R 13/506 439/620.05 |
| 2016/0156119 | A1 | 6/2016 | Lee et al. | |
| 2017/0040731 | A1 * | 2/2017 | Nishiyama | H01R 11/01 |
| 2019/0109416 | A1 * | 4/2019 | Tsukamoto | H01R 13/7197 |
| 2019/0109417 | A1 | 4/2019 | Tsukamoto et al. | |
| 2019/0109418 | A1 * | 4/2019 | Tsukamoto | H01R 4/2433 |

* cited by examiner

FIG. 1 "PRIOR ART"

FIG. 7
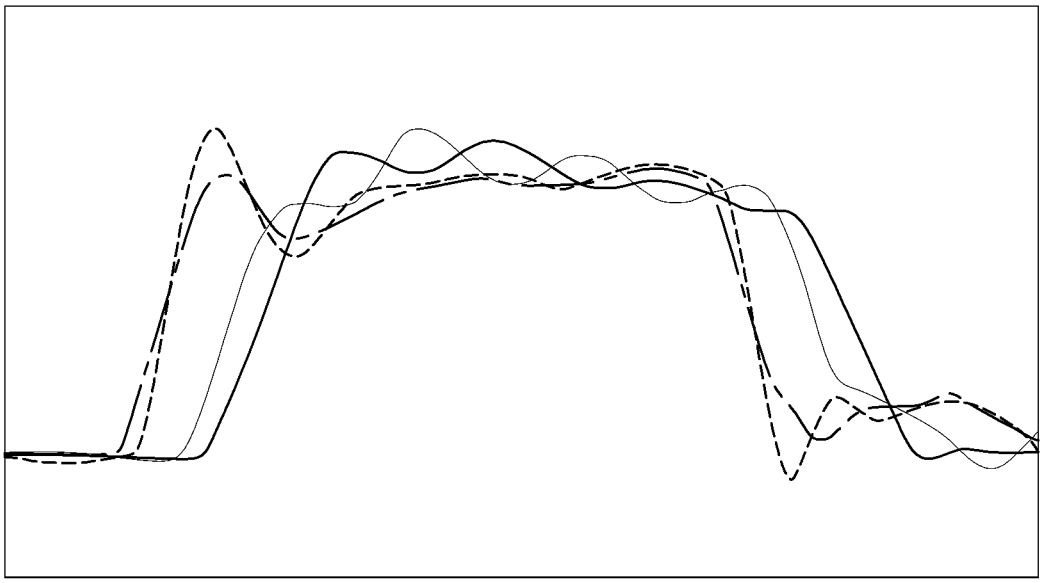
BEFORE APPLYING FILTER
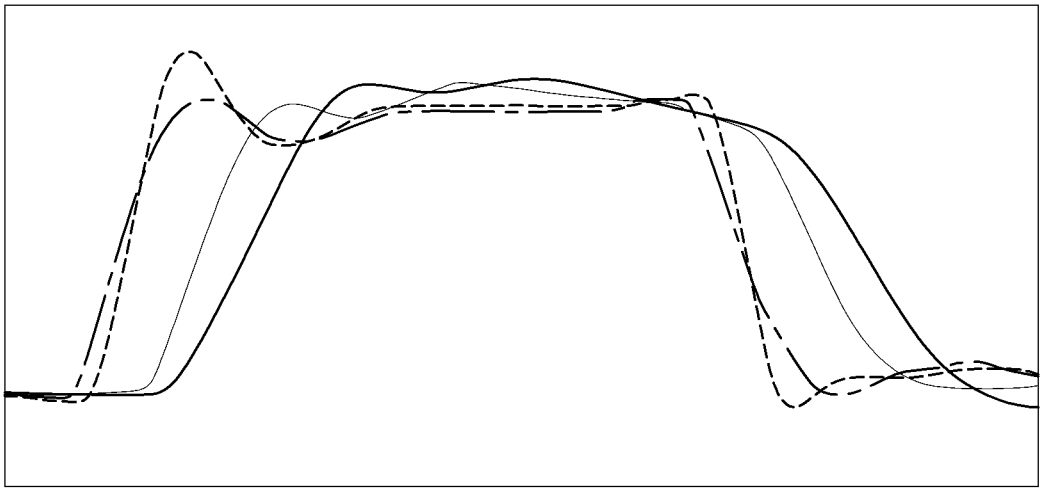
AFTER APPLYING FILTER

CONNECTOR ASSEMBLY HAVING A TERMINAL POSITION ASSURANCE MECHANISM

CROSS REFERENCE TO RELATED APPLICATION

This application claims priority to and the benefit of Korean Patent Application No. 10-2020-0133681, filed on Oct. 15, 2020, the entire contents of which are incorporated herein by reference.

FIELD

The present disclosure relates to a connector assembly.

BACKGROUND

The statements in this section merely provide background information related to the present disclosure and may not constitute prior art.

Recently, various electronic devices have been developed. Such an electronic device includes a housing formed of an insulating material, and a connector formed in the housing and including terminals formed of a conductive material, and the terminals are electrically connected by the connector to form a circuit.

In particular, information is transferred to a joint connector applied to wiring of a vehicle through controller area network (CAN) in a vehicle, and a large amount of information is transferred to a communication joint connector for a vehicle safety and convenience system.

Further, malfunction is caused by noise generated in a transmitted signal due to an increased communication speed resulting from the change into controller area network with flexible data-rate (CAN FD), which is a critical problem.

FIG. 1 is an exploded perspective view of a connector assembly according to the related art.

Referring to FIG. 1, in the connector assembly according to the related art, a cover 30 in which joint terminals 20 are provided is coupled to a housing 10. Since the joint terminals 20 are coupled by the separate cover 30, a great insertion force is desired at the time of fastening, and thus the fastening may be incomplete, which is problematic.

In addition, we have discovered that noise included in a signal input to the joint terminal 20 through a terminal inserted into the housing 10 is transferred through the joint terminal 20 and other terminals as it is.

The matters described as the related art have been provided only for assisting in the understanding for the background of the present disclosure and should not be considered as corresponding to the related art known to those skilled in the art.

SUMMARY

The present disclosure provides a connector assembly that reduces noise included in a signal input to a joint terminal through a terminal inserted into a housing.

According to one form of the present disclosure, a connector assembly includes: a housing having a plurality of accommodating grooves into which a plurality of terminals are insertable, respectively, and having an insertion space recessed in a first direction intersecting a second direction in which the accommodating grooves extend, the plurality of accommodating grooves being formed in one surface of the housing; a terminal position assurance (TPA) mechanism inserted into the insertion space of the housing in the first direction intersecting the second direction in which the accommodating grooves extend, and preventing the plurality of terminals inserted into the accommodating grooves from being separated; and a connection device fixed to the housing or the TPA mechanism and forming a circuit electrically connected to the plurality of terminals inserted into the accommodating grooves.

The connection device may be joint terminals that are fixed in the housing and extend toward the plurality of accommodating grooves, respectively, while being in an integrally connected state.

The connection device may be fixed to the TPA mechanism in a state where a part of the connection device is exposed to an inside of the insertion space so as to be electrically connected to the plurality of terminals inserted into the accommodating grooves.

The connection device may include a circuit board coupled to the TPA mechanism, and a plurality of connection terminals electrically connected to the circuit board and electrically connected to the terminals inserted into the accommodating grooves, respectively.

The plurality of connection terminals may have one end portions coupled to the circuit board and extending in a direction parallel to a direction in which the terminals inserted into the accommodating grooves extend, and the other end portions elastically coupled to the terminals inserted into the accommodating grooves, in a state being spaced apart from the circuit board.

The plurality of connection terminals may be arranged on the circuit board so as to be spaced apart from each other in a direction intersecting the direction in which the terminals inserted into the accommodating grooves extend.

The TPA mechanism may cover parts of the plurality of connection terminals coupled to the circuit board from the accommodating grooves, and in the TPA mechanism, blocking portions protruding toward the accommodating grooves between the plurality of connection terminals spaced apart from each other may be formed.

Ferrite cores may be coupled to the circuit board, the ferrite cores filtering out electromagnetic interference included in a signal input from the connection terminals.

In the connection device, noise filters may be provided, the noise filters filtering out electromagnetic interference included in a signal input from the terminals inserted into the accommodating grooves.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 7 illustrates signal waveforms before and after applying the connector assembly in one form of the present disclosure.

Figure 1:
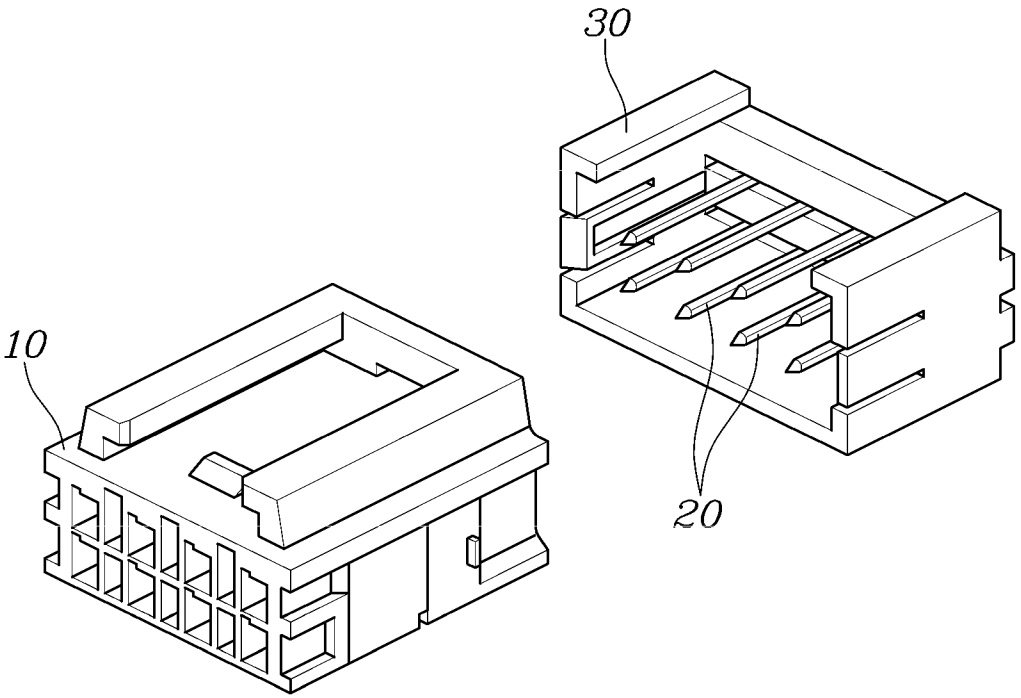
FIG. 1 is an exploded perspective view of a connector assembly according to the related art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Specific structural and functional descriptions will be provided only in order to describe various forms of the present disclosure disclosed in the present specification or disclosure. Therefore, forms of the present disclosure may be implemented in various forms, and the present disclosure is not to be interpreted as being limited to forms described in the present specification or disclosure.

Since forms of the present disclosure may be variously modified and may have several forms, specific forms will be shown in the accompanying drawings and will be described in detail in the present specification or disclosure. However, it is to be understood that the present disclosure is not limited to specific forms, but includes all modifications, equivalents, and substitutions included in the spirit and the scope of the present disclosure.

Terms such as "first", "second", etc., may be used to describe various components, but the components are not to be construed as being limited to the terms. The terms are used only to distinguish one component from another component. For example, the "first" component may be named the "second" component and the "second" component may also be similarly named the "first" component, without departing from the scope of the present disclosure.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Other expressions describing a relationship between components, that is, "between", "directly between", "neighboring to", "directly neighboring to" and the like, should be similarly interpreted.

Terms used in the present specification are used only in order to describe specific forms rather than limiting the present disclosure. Singular forms used herein are intended to include plural forms unless context explicitly indicates otherwise. It will be further understood that the terms "comprise" or "have" used in this specification, specify the presence of stated features, steps, numerals, operations, components, parts, or a combination thereof, but do not preclude the presence or addition of one or more other features, numerals, steps, operations, components, parts, or a combination thereof.

Unless indicated otherwise, it is to be understood that all the terms used in the specification including technical and scientific terms have the same meaning as those that are understood by those who skilled in the art. It must be understood that the terms defined by the dictionary are identical with the meanings within the context of the related art, and they should not be ideally or excessively formally defined unless the context clearly dictates otherwise.

Hereinafter, forms of the present disclosure will be described in detail with reference to the accompanying drawings. Like reference numerals proposed in each drawing denote like components.

Figure 2:
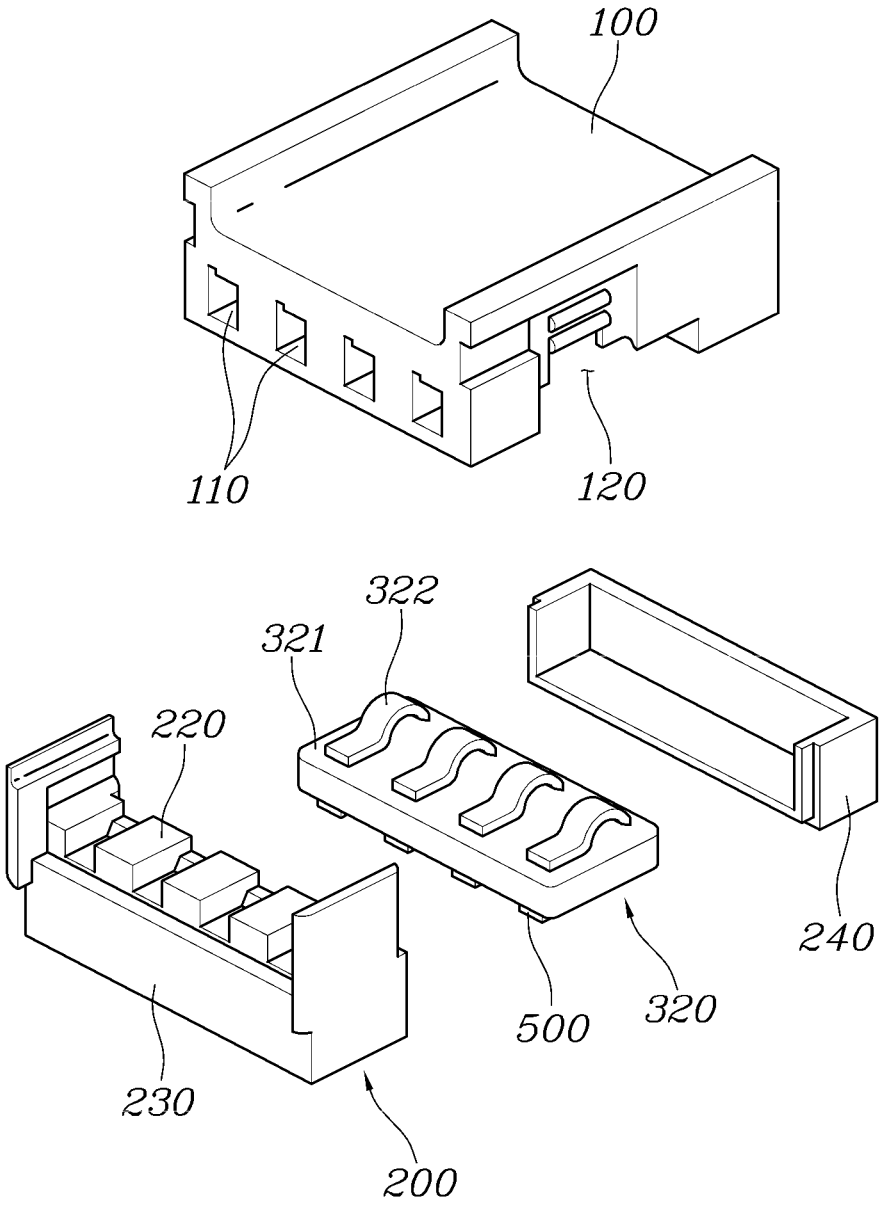
FIG. 2 is an exploded perspective view of a connector assembly according to one form of the present disclosure.
Figure 3:
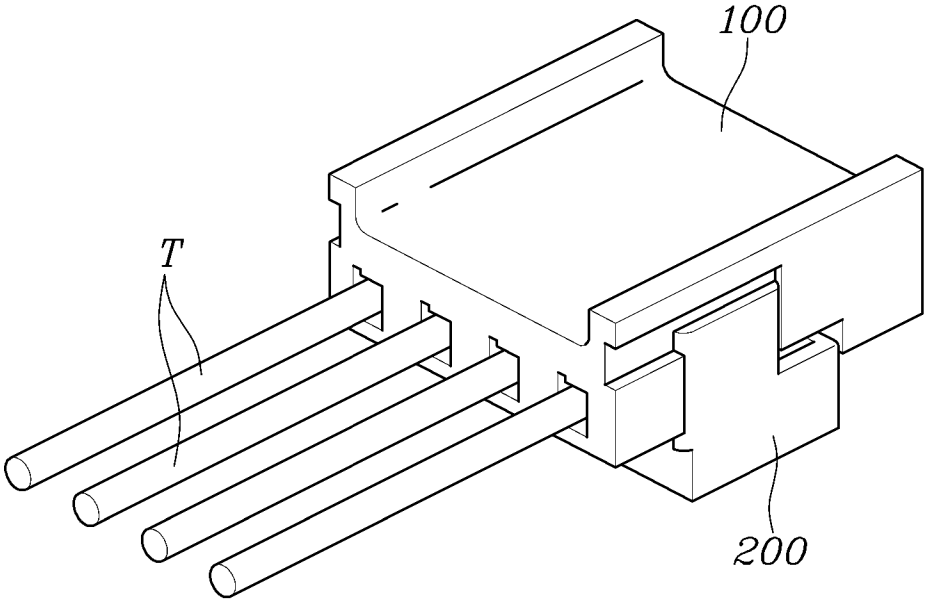
FIGS. 3 and 4 are a perspective view and a cross-sectional view illustrating a state where a plurality of terminals are inserted in a connector assembly according to another form of the present disclosure, respectively.
Figure 4:
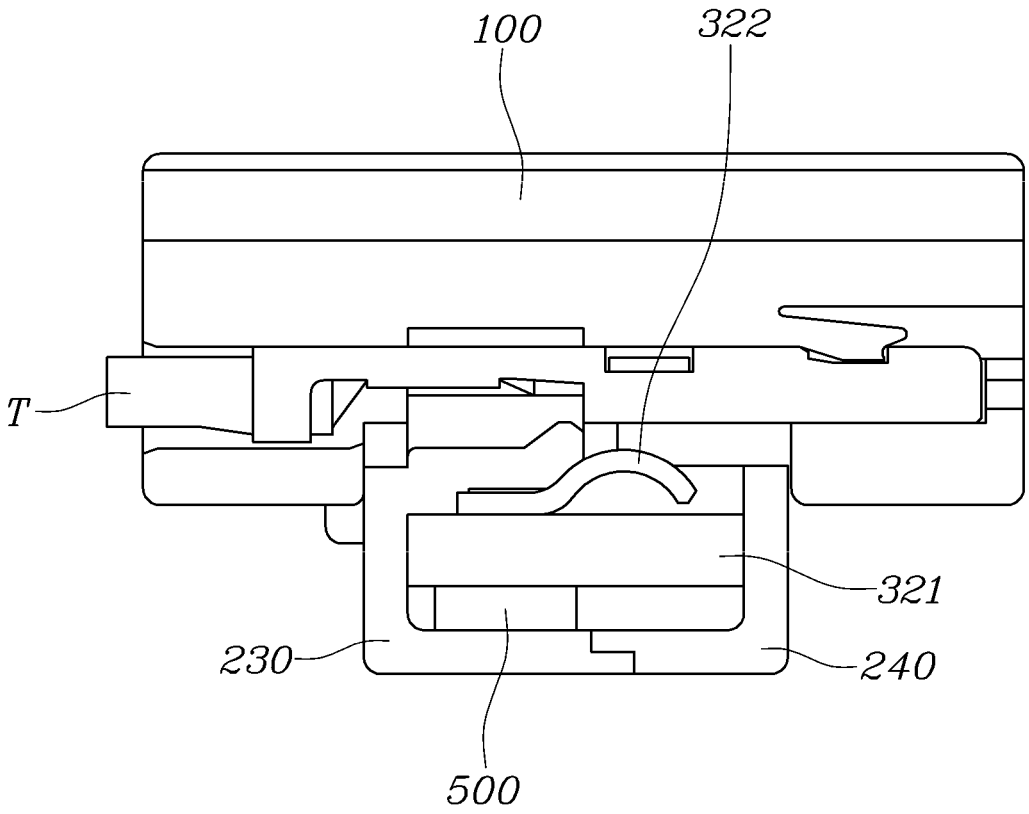

FIG. 2 is an exploded perspective view of a connector assembly according to one form of the present disclosure, and FIGS. 3 and 4 are a perspective view and a cross-sectional view illustrating a state where a plurality of terminals are inserted in a connector assembly according to another form of the present disclosure, respectively.

Referring to FIGS. 2 to 4, the connector assembly in one form of the present disclosure includes: a housing 100 having a plurality of accommodating grooves 110 into which a plurality of terminals T are insertable, respectively, and having an insertion space 120 recessed in a direction intersecting a direction in which the accommodating grooves 110 extend, the plurality of accommodating grooves 110 being formed in one surface of the housing 100; a terminal position assurance (TPA) mechanism 200 inserted into the insertion space 120 of the housing 100 in the direction intersecting the direction in which the accommodating grooves 110 extend, and preventing the plurality of terminals T inserted into the accommodating grooves 110 from being separated; and a connection device 320 fixed to the housing 100 or the TPA mechanism 200 and forming a circuit electrically connected to the plurality of terminals T inserted into the accommodating grooves 110.

The plurality of accommodating grooves 110 may be formed in one side surface of the housing 100. The plurality of accommodating grooves 110 may be recessed inward at one side surface of the housing 100, extend parallel to each other, and be spaced apart from each other.

Further, the insertion space 120 that is recessed in the direction intersecting the direction in which the accommodating grooves 110 extend, particularly, in an upward direction or downward direction, may be formed in an upper surface or lower surface of the housing 100. The TPA mechanism 200 as described later may be inserted into the insertion space 120 and fixed to the housing 100.

The TPA mechanism is a component inserted into the insertion space of the housing 100, and may be inserted in the direction intersecting the direction in which the accommodating grooves 110 extend.

The TPA mechanism 200 may have through-holes 210 extending in a direction parallel to the direction in which the accommodating grooves 110 of the housing 100 extend, or extending grooves between blocking portions 220 as described later. The terminals T inserted into the accommodating grooves 110 may be inserted into the through-holes 210 or the extending grooves in a state where the TPA mechanism 200 is inserted into the insertion space 120 of the housing 100. The TPA mechanism 200 may inhibit or prevent the terminals T inserted into the accommodating grooves 110 from being separated.

The connection device 320 may be fixed to the housing 100 or the TPA mechanism 200 and form a circuit so that the plurality of terminals T inserted into the accommodating grooves 110 are electrically connected to each other.

According to the related art, a cover to which a connection device is fixed is separately coupled to a housing into which the plurality of terminals T are inserted. In this case, a great insertion force is desired to fasten the cover. In addition, as the number of plurality of terminals T inserted into the housing increases, a greater insertion force is desired, and since an excessive insertion force is desired, fastening quality deteriorates.

In the connector assembly according to exemplary forms of the present disclosure, a cover separately coupled to the housing 100 is omitted, such that the assembling process is simplified and fastening quality is improved.

In one form, the connection device 320 may be joint terminals 310 that are fixed in the housing 100 and extend toward the plurality of accommodating grooves 110, respectively, while being in an integrally connected state.

The joint terminals 310 may extend toward the plurality of accommodating grooves 110, respectively, and may be connected to each other on a side opposite to one side surface in which the accommodating grooves 110 are formed.

The joint terminals 310 may be integrally coupled in the housing 100 by insert injection molding or the like, or may be inserted into the plurality of accommodating grooves 110 from the side opposite to one side surface in which the accommodating grooves 110 are formed.

In addition, the connector assembly may further include a protection cap (not illustrated) that is coupled to the housing 100 at a surface facing the surface of the housing 100 in which the accommodating grooves 110 are formed, and externally covers the connection device 320.

The protection cap (not illustrated) may have a plane shape extending in a direction parallel to one side surface of the housing 100, and may be integrally coupled to the housing 100 in a state where the connection device 320 is coupled to the housing 100.

According to one form, the protection cap (not illustrated) may externally cover the joint terminals 310 exposed at a surface opposite to the one side surface in which the accommodating grooves 110 are formed, thereby preventing the joint terminals 310 from being in contact to the outside.

Figure 5:
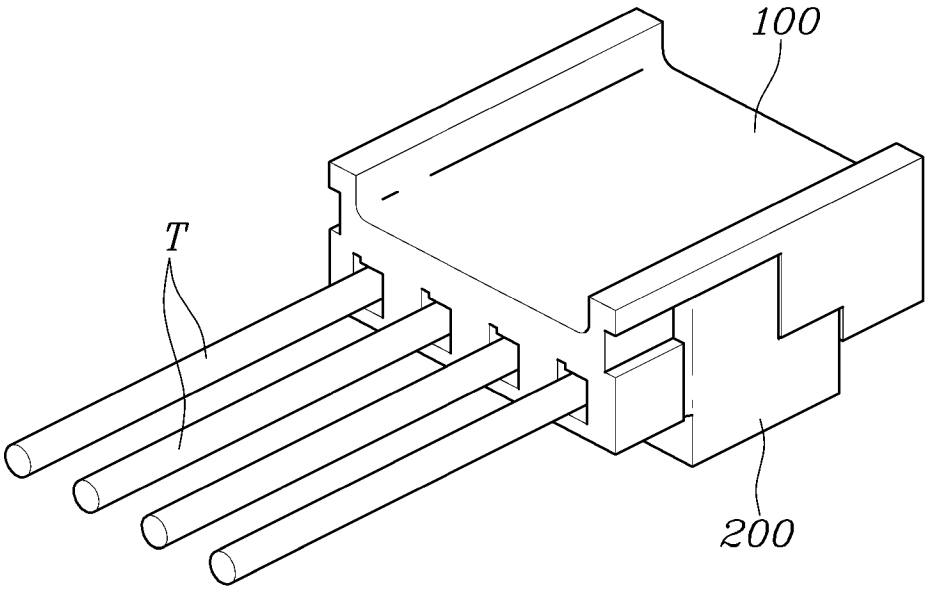
FIGS. 5 and 6 are a perspective view and a cross-sectional view illustrating a state where a TPA mechanism is inserted in a connector assembly according to another form of the present disclosure, respectively.
Figure 6:
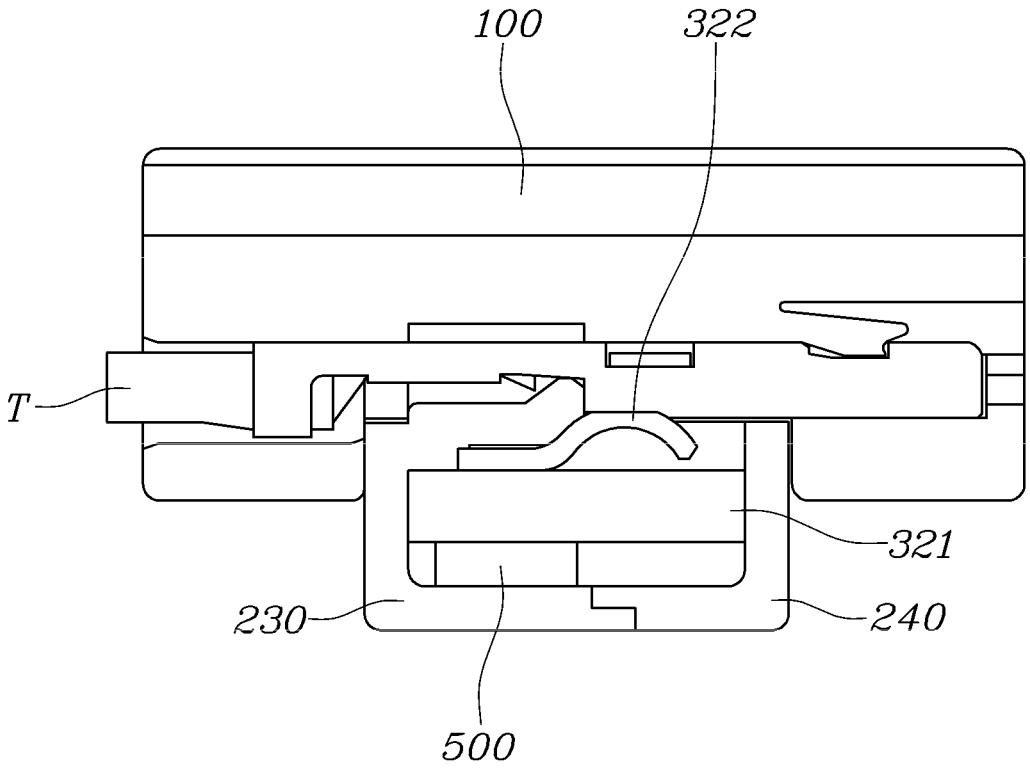

FIGS. 5 and 6 are a perspective view and a cross-sectional view illustrating a state where the TPA mechanism 200 is inserted in a connector assembly according to another form of the present disclosure, respectively.

Referring to FIGS. 5 and 6, the connection device 320 according to another form of the present disclosure may be fixed to the TPA mechanism 200 in a state where a part of the connection device 320 is exposed to the inside of the insertion space 120 so as to be electrically connected to the plurality of terminals T inserted into the accommodating grooves 110.

In other form, the TPA mechanism 200 may be inserted into the insertion space 120 of the housing 100 in a state where the plurality of terminals T are inserted into the accommodating grooves 110, such that the plurality of terminals T may be electrically connected to the connection device 320. FIG. 2 illustrates a state before the TPA mechanism 200 is fixed to the housing 100, and FIGS. 3 to 6 illustrate a state where the TPA mechanism 200 is coupled to the housing 100 so as to be fixed to the housing 100.

The connection device 320 may be fixed to the TPA mechanism 200 instead of the housing 100, and may be electrically connected to the plurality of terminals T inserted into the accommodating grooves 110 of the housing 100 as the TPA mechanism 200 is inserted into the housing 100.

In particular, the connection device 320 may be fixed to the TPA mechanism 200 so that a part of the connection device 320 that is electrically connected to the plurality of terminals T is exposed to the insertion space 120 of the housing 100. According to another form, in the connection device 320 and the TPA mechanism 200 inserted into the insertion space 120 formed in a lower surface of the housing 100, a part of the connection device 320 may be exposed upward at the TPA mechanism.

More specifically, the connection device 320 may include a circuit board 321 coupled to the TPA mechanism 200, and a plurality of connection terminals 322 electrically connected to the circuit board 321 and electrically connected to the terminals T inserted into the accommodating grooves 110, respectively.

The connection device 320 may include the circuit board 321 fixed to the TPA mechanism 200 in a state of being inserted into the TPA mechanism 200, and the plurality of connection terminals 322 coupled to the circuit board 321 so as to be electrically connected to the circuit board 321. According to an exemplary form, the circuit board 321 may be a printed circuit board (PCB) 321.

Particularly, the plurality of connection terminals 322 may protrude from one surface (for example, an upper surface) of the circuit board 321 that faces the insertion space 120, and may be electrically connected to the terminals T inserted into the accommodating grooves 110, respectively.

In one form, the plurality of connection terminals 322 may have one end portions coupled to the circuit board 321 and extending in a direction parallel to a direction in which the terminals T inserted into the accommodating grooves 110 extend, and the other end portions elastically coupled to the terminals T inserted into the accommodating grooves 110, in a state being spaced apart from the circuit board 321.

The one end portions of the connection terminals 322 may be coupled so as to be electrically connected to the circuit board 321. In particular, the one end portions of the connection terminals 322 may be end portions that face the accommodating grooves 110 into which the terminals T are inserted.

The other end portions of the connection terminals 322 that extend in the direction parallel to the direction in which the terminals T inserted into the accommodating grooves 110 extend may be free ends. Particularly, the other end portions of the connection terminals 322 may protrude toward the insertion space 120, and may be elastically coupled to the terminals T inserted into the accommodating grooves 110, in a state of being spaced apart from the circuit board 321.

That is, as the other end portions of the connection terminals 322 are pressed downward by the terminals T inserted into the accommodating grooves 110, the connection terminals 322 are elastically deformed, such that the connection terminals 322 may be elastically coupled so as to adhere to the terminals T inserted into the accommodating grooves 110.

In addition, the plurality of connection terminals 322 may be arranged on the circuit board 321 so as to be spaced apart from each other in a direction intersecting the direction in which the terminals T inserted into the accommodating grooves 110 extend.

The plurality of connection terminals 322 may be arranged parallel to the plurality of accommodating grooves 110 formed to be spaced apart from each other, and thus may be connected to the plurality of terminals T inserted while being spaced apart from each other, respectively.

The TPA mechanism 200 may cover parts of the plurality of connection terminals 322 coupled to the circuit board 321 from the accommodating grooves 110, and in the TPA mechanism 200, blocking portions 220 protruding toward the accommodating grooves 110 between the plurality of connection terminals 322 spaced apart from each other may be formed.

The TPA mechanism 200 may be formed by coupling a first part 230 and a second part 240 that are separate from each other to each other, and the circuit board 321 or connection device 320 may be fixed between the first part 230 and the second part 240 that are separate from each other. In particular, the first part 230 and the second part 240 may be coupled to each other in a direction parallel to the direction in which the terminals T inserted into the accommodating grooves 110 extend.

More specifically, the TPA mechanism 200 may be coupled so that the first part 230 and the second part 240 that are separate from each other cover the one end portions of the plurality of connection terminals 322 coupled to the circuit board 321 from the accommodating grooves 110.

Further, in the TPA mechanism 200, the blocking portions 220 disposed between the plurality of connection terminals 322 spaced apart from each other, and protruding from one surface of the TPA mechanism 200 toward the accommodating grooves 110 may be formed. The blocking portions 220 may be disposed between the terminals T inserted into the accommodating grooves 110, in a state of being spaced apart from each other.

As a result, it is possible to prevent electromagnetic interference generated in the plurality of terminals T inserted into the accommodating grooves 110 from being transferred between the plurality of terminals T.

In the connection device 320, noise filters 500 that filter out electromagnetic interference included in a signal input from the terminals T inserted into the accommodating grooves 110 may be provided.

According to one form, ferrite cores 500 that filter out electromagnetic interference included in a signal input from the connection terminals 322 or chip beads having the same function as that of the ferrite cores 500 may be coupled to the circuit board 321. Here, it is assumed that the ferrite core 500 includes the chip bead having the same function as that of the ferrite core.

Particularly, the ferrite cores 500 may be positioned on a surface of the circuit board 321 that is opposite to a surface of the circuit board 321 to which the connection terminals 322 are coupled, and may be coupled to the circuit board 321 at positions corresponding to positions of the connection terminals 322.

According to another form, the ferrite cores 500 may be coupled to the joint terminals 310 electrically directly connected to the plurality of terminals T.

The noise filter 500 may be the above-described ferrite core, or the circuit board 321 may further include a filtering element that filters out noise.

As a result, noise included in a signal input to the joint terminals 310 through the terminals T inserted in the connector assembly is reduced.

FIG. 7 illustrates signal waveforms before and after applying the connector assembly according to one form of the present disclosure.

Referring to FIG. 7, with the change of a communication protocol from controller area network (CAN) into controller area network with flexible data-rate (CAN FD), a communication speed has increased and a communication cycle has decreased. In a case of the CAN communication, a section in which a signal is instable due to noise is short, but in a case of the CAN FD communication with the increased communication speed and decreased communication cycle, a section in which a signal is instable due to noise is relatively long.

That is, in a case of the CAN FD communication, it is likely that a vehicle malfunctions due to noise of a signal or the like of a controller.

However, as illustrated in FIG. 7, in a case of applying the noise filter according to the present disclosure, signal instability due to noise is relatively reduced, such that a section in which a signal is stable increases.

In the connector assembly according to the present disclosure, a cover separately coupled to the housing is omitted, such that the assembling process is simplified and fastening quality is improved.

In addition, noise included in a signal input to the joint terminal through the terminal inserted into the connector assembly is reduced.

Although the present disclosure has been shown and described with respect to the exemplary forms, it will be obvious to those skilled in the art that the present disclosure may be variously modified and altered without departing from the spirit and scope of the present disclosure.

What is claimed is:

1. A connector assembly comprising:

a housing including:

a plurality of accommodating grooves into which a plurality of terminals are insertable, respectively, and an insertion space recessed in a first direction intersecting a second direction in which the plurality of accommodating grooves extend, the plurality of accommodating grooves being formed in one surface of the housing;

a terminal position assurance (TPA) mechanism configured to be inserted into the insertion space of the housing in the first direction intersecting the second direction, and configured to inhibit the plurality of terminals inserted into the plurality of accommodating grooves from being separated; and a connection device fixed to the TPA mechanism and configured to form a circuit electrically connected to the plurality of terminals inserted into the plurality of accommodating grooves, wherein the connection device includes:

a circuit board coupled to the TPA mechanism, and a plurality of connection terminals electrically connected to the circuit board and electrically connected to the plurality of terminals inserted into the plurality of accommodating grooves, respectively.

2. The connector assembly of claim 1, wherein the connection device is joint terminals that are fixed in the housing and extend toward the plurality of accommodating grooves, respectively, while being in an integrally connected state.

3. The connector assembly of claim 1, wherein the connection device is fixed to the TPA mechanism in a state where a part of the connection device is exposed to an inside of the insertion space so as to be electrically connected to the plurality of terminals inserted into the plurality of accommodating grooves.

4. The connector assembly of claim 1, wherein the plurality of connection terminals include:

first end portions coupled to the circuit board and configured to extend in a direction parallel to a direction in which the plurality of terminals inserted into the plurality of accommodating grooves extends, and second end portions elastically coupled to the plurality of terminals inserted into the plurality of accommodating grooves, in a state being spaced apart from the circuit board.

5. The connector assembly of claim 1, wherein the plurality of connection terminals is arranged on the circuit board so as to be spaced apart from each other in a direction intersecting a direction in which the plurality of terminals inserted into the plurality of accommodating grooves extends.

6. The connector assembly of claim 5, wherein:

the TPA mechanism covers parts of the plurality of connection terminals coupled to the circuit board, and the TPA mechanism includes blocking portions configured to protrude toward the plurality of accommodating grooves and be disposed between connection terminals of the plurality of connection terminals.

7. The connector assembly of claim 1, wherein:

ferrite cores are coupled to the circuit board, and the ferrite cores configured to filter out electromagnetic interference included in a signal input from the plurality of connection terminals.

8. The connector assembly of claim 1, wherein:

the connection device is provided with noise filters configured to filter out electromagnetic interference included in a signal input from the plurality of terminals inserted into the plurality of accommodating grooves.

* * * * *